US012178251B2

(12) United States Patent
Paton

(10) Patent No.: US 12,178,251 B2
(45) Date of Patent: Dec. 31, 2024

(54) AEROSOL GENERATION

(71) Applicant: Nicoventures Trading Limited, London (GB)

(72) Inventor: David Paton, London (GB)

(73) Assignee: NICOVENTURES TRADING LIMITED, London (GB)

( * ) Notice: Subject to any disclaimer, the term of this patent is extended or adjusted under 35 U.S.C. 154(b) by 638 days.

(21) Appl. No.: 17/593,132

(22) PCT Filed: Mar. 9, 2020

(86) PCT No.: PCT/EP2020/056266
§ 371 (c)(1),
(2) Date: Sep. 10, 2021

(87) PCT Pub. No.: WO2020/182770
PCT Pub. Date: Sep. 17, 2020

(65) Prior Publication Data

US 2022/0142256 A1 May 12, 2022

(30) Foreign Application Priority Data

Mar. 11, 2019 (GB) ..... 1903273
Mar. 11, 2019 (GB) ..... 1903275

(51) Int. Cl.
*A24F 40/465* (2020.01)
*A24F 40/20* (2020.01)
*A24F 40/57* (2020.01)

(52) U.S. Cl.
CPC ..... *A24F 40/465* (2020.01); *A24F 40/20* (2020.01); *A24F 40/57* (2020.01)

(58) Field of Classification Search
CPC ..... A24F 40/00; A24F 40/20; A24F 40/50; A24F 40/57; A24F 40/40; A24F 40/46; A24F 40/465

(Continued)

(56) References Cited

U.S. PATENT DOCUMENTS

2019/0380391 A1* 12/2019 Reevell ..... A24F 40/465
2022/0142256 A1* 5/2022 Paton ..... A24F 40/57

FOREIGN PATENT DOCUMENTS

JP 2009169271 A 7/2009
JP 2014524313 A 9/2014

(Continued)

OTHER PUBLICATIONS

"International Preliminary Report on Patentability received for PCT Patent Application No. PCT/EP2020/056266, mailed on Sep. 23, 2021", 9 pages.

(Continued)

*Primary Examiner* — Khiem M Nguyen
(74) *Attorney, Agent, or Firm* — Husch Blackwell

(57) ABSTRACT

Disclosed herein is an aerosol generating system comprising (i) an aerosol generating article comprising an aerosol generating material, the aerosol generating material comprising nicotine and an aerosol generating agent, and (ii) an aerosol generating device comprising an induction heater; wherein during operation, the article is inserted into the device and an aerosol is generated by using the induction heater to heat the aerosol generating material to at least 150° C.; wherein (i) the mean particle or droplet size in the generated aerosol is less than about 1000 nm in an aerosol generated under an airflow of at least 1.50 L/m during a two-second period, and/or (ii) wherein the aerosol density generated during a two-second period under an airflow of at least 1.50 L/m during the period, is at least 0.1 μg/cc.

17 Claims, 12 Drawing Sheets

(58) Field of Classification Search
USPC ..... 131/329
See application file for complete search history.

(56) References Cited

FOREIGN PATENT DOCUMENTS

| | | | |
|---|---|---|---|
| JP | 2016515417 | A | 5/2016 |
| JP | 2016539645 | A | 12/2016 |
| JP | 7272611 | B2 | 5/2023 |
| RU | 105564 | U1 | 6/2011 |
| RU | 2470680 | C2 | 12/2012 |
| RU | 2568068 | C2 | 11/2015 |
| WO | 2015042417 | A1 | 3/2015 |
| WO | 2015176898 | A1 | 11/2015 |
| WO | 2017097840 | A1 | 6/2017 |
| WO | 2017207581 | A1 | 12/2017 |
| WO | 2018146071 | A1 | 8/2018 |
| WO | 2019030360 | A1 | 2/2019 |

OTHER PUBLICATIONS

"International Search Report and Written Opinion received for PCT Patent Application No. PCT/EP2020/056266, mailed on Jun. 25, 2020", 14 pages.
"Office Action received for Russian Patent Application No. 2021126488, mailed on Jun. 22, 2022", 13 pages.

* cited by examiner

AEROSOL GENERATION

PRIORITY CLAIM

The present application is a National Phase entry of PCT Application No. PCT/EP2020/056266, filed Mar. 9, 2020, which claims priority from Great Britain Application No. 1903275.4, filed Mar. 11, 2019, and which claims priority from Great Britain Application No. 1903273.9, filed Mar. 11, 2019, each of which is hereby fully incorporated herein by reference.

TECHNICAL FIELD

The present invention relates to a method of generating an aerosol and an aerosol generating system.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

SUMMARY

A first aspect of the invention provides an aerosol generating system comprising (i) an aerosol generating article comprising an aerosol generating material, the aerosol generating material comprising nicotine and an aerosol generating agent, and (ii) an aerosol generating device comprising an induction heater, wherein during operation, the article is inserted into the device and an aerosol is generated by using the induction heater to heat the aerosol generating material to at least 150° C., wherein the mean particle or droplet size in the generated aerosol is less than about 1000 nm in an aerosol generated under an airflow of at least 1.50 L/m during a two-second period.

A second aspect of the invention provides a method of generating an aerosol from an aerosol generating material that comprises nicotine and an aerosol generating agent, the method comprising using an induction heater to heat the aerosol generating material to at least 150° C., wherein the mean particle or droplet size in the generated aerosol is less than about 1000 nm in an aerosol generated under an airflow of at least 1.50 L/m during a two-second period.

A further aspect of the invention provides an aerosol having a mean particle or droplet size in the generated aerosol of less than about 1000 nm, obtainable or obtained by induction heating an aerosol generating material to at least 150° C., under an airflow of at least 1.50 L/m for a two-second period.

A fourth aspect of the invention provides an aerosol generating system comprising (i) an aerosol generating article comprising an aerosol generating material, the aerosol generating material comprising nicotine and an aerosol generating agent, and (ii) an aerosol generating device comprising an induction heater, wherein during operation, the article is inserted into the device and an aerosol is generated by using the induction heater to heat the aerosol generating material to at least 150° C., wherein the aerosol density generated during a two-second period under an airflow of at least 1.50 L/m during the period, is at least 0.1 μg/cc.

A fifth aspect of the invention provides a method of generating an aerosol from an aerosol generating material that comprises nicotine and an aerosol generating agent, the method comprising using an induction heater to heat the aerosol generating material to at least 150° C., wherein the aerosol density generated during a two-second period under an airflow of at least 1.50 L/m, is at least 0.1 μg/cc.

A sixth aspect of the invention provides an aerosol with a density of at least 0.1 μg/cc, obtainable or obtained by induction heating an aerosol generating material to at least 150° C., under an airflow of at least 1.50 L/m for a two-second period.

Features described herein in relation to one aspect of the invention are explicitly disclosed in combination with the other aspects, to the extent that they are compatible.

Further features and advantages of the invention will become apparent from the following description of preferred embodiments of the invention, given by way of example only, which is made with reference to the accompanying drawings.

DETAILED DESCRIPTION OF THE DRAWINGS

Figure 1:
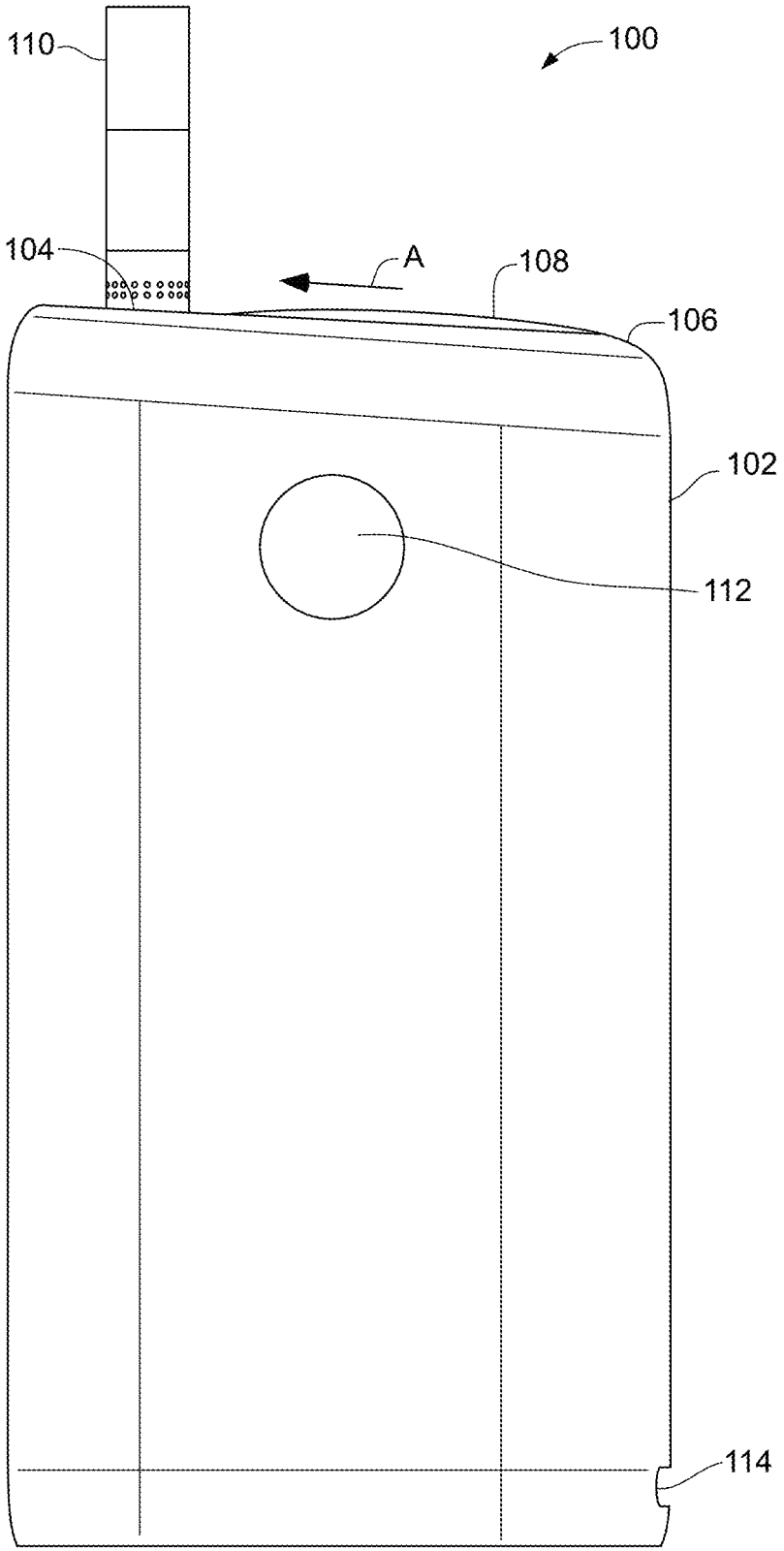
FIG. 1 shows a front view of an example of an aerosol generating device.

As used herein, the term "aerosol generating material" includes materials that provide volatilised components upon heating, typically in the form of an aerosol. Aerosol generating material includes any tobacco-containing material and may, for example, include one or more of tobacco, tobacco derivatives, expanded tobacco, reconstituted tobacco or tobacco substitutes. Aerosol generating material also may include other, non-tobacco, products, which, depending on the product, may or may not contain nicotine. Aerosol generating material may for example be in the form of a solid, a liquid, a gel, a wax or the like. Aerosol generating material may for example also be a combination or a blend of materials. Aerosol generating material may also be known as "smokable material" or "aerosolizable material".

Apparatuses are known that heat aerosol generating material to volatilise at least one component of the aerosol generating material, typically to form an aerosol which can be inhaled, without burning or combusting the aerosol generating material. Such apparatus is sometimes described as an "aerosol generating device," an "aerosol provision device," a "heat-not-burn device," a "tobacco heating product device," or a "tobacco heating device" or similar. Similarly, there are also so-called e-cigarette devices, which typically vaporise an aerosol generating material in the form of a liquid, which may or may not contain nicotine. The aerosol generating material may be in the form of or be provided as part of a rod, cartridge or cassette or the like which can be inserted into the apparatus. A heater for heating and volatilising the aerosol generating material may be provided as a "permanent" part of the apparatus.

An aerosol generating device can receive an article comprising aerosol generating material for heating. An "article" in this context is a component that includes or contains in use the aerosol generating material, which is heated to volatilise the aerosol generating material, and optionally other components in use. A user may insert the article into the aerosol generating device before it is heated to produce an aerosol, which the user subsequently inhales. The article may be, for example, of a predetermined or specific size that is configured to be placed within a heating chamber of the device which is sized to receive the article.

The inventors have found that the use of an induction heater allows more rapid heating and therefore a higher temperature to be achieved within a set period. Greater control over the heat profile is also possible as the heater is more responsive to instructed changes. The heat profile affects the aerosol constitution and composition. An aerosol particle size that is too large or too small is thought to negatively affect the mouth feel and consequently, the user satisfaction.

As noted above, a first aspect of the invention provides a method of generating an aerosol from an aerosol generating material that comprises nicotine and an aerosol generating agent, the method comprising using an induction heater to heat the aerosol generating material to at least 150° C., wherein the mean particle or droplet size in the generated aerosol is less than about 1000 nm in an aerosol generated under an airflow of at least 1.50 L/m during a two-second period.

As defined herein, the term "mean particle or droplet size" refers to the mean size of the solid or liquid components of an aerosol (i.e., the components suspended in a gas). Where the aerosol contains suspended liquid droplets and suspended solid particles, the term refers to the mean size of all components together.

As noted above, a fourth aspect of the invention provides a method of generating an aerosol from an aerosol generating material that comprises nicotine and an aerosol generating agent, the method comprising using an induction heater to heat the aerosol generating material to at least 150° C., wherein the aerosol density generated during a two-second period under an airflow of at least 1.50 L/m, is at least 0.1 μg/cc.

The following discussion relates to either or both of the first and fourth aspects, to the extent that it is compatible.

In some cases, the mean particle or droplet size in the generated aerosol may be less than about 1000 nm, 900 nm, 800 nm, 700, nm 600 nm, 500 nm, 450 nm or 400 nm. In some cases, the mean particle or droplet size may be more than about 25 nm, 50 nm or 100 nm.

In some cases, the aerosol density generated during the two-second period is at least 0.1 μg/cc. In some cases, the aerosol density is at least 0.2 μg/cc, 0.3 μg/cc or 0.4 μg/cc. In some cases, the aerosol density is less than about 2.5 μg/cc, 2.0 μg/cc, 1.5 μg/cc or 1.0 μg/cc.

In some cases, the aerosol generated during the two-second period contains at least 10 μg of the aerosol generating agent. Suitably at least 100 μg 200 μg, 500 μg or 1 mg of aerosol generating agent is aerosolised from the aerosol generating material under an airflow of at least 1.50 L/m during the period. Suitably, the aerosol generating agent may comprise or consist of glycerol.

In some cases, at least 10 μg of nicotine, suitably at least 30 μg or 40 μg of nicotine, is aerosolised from the aerosol generating material during the two-second period. In some cases, less than about 200 μg, suitably less than about 150 μg or less than about 125 μg, of nicotine is aerosolised from the aerosol generating material during the two-second period.

In some cases, the aerosol generating material is a solid or a gel material. That is, the method may be a method of generating an aerosol from a tobacco heating product, also known as a heat-not-burn device. In some cases, the aerosol generating material comprises tobacco. In some cases, the aerosol generating material is solid and comprises tobacco.

In some cases, the aerosol generating material comprises a reconstituted tobacco material. In some cases, it comprises or consists of about 220 mg to about 400 mg of reconstituted tobacco material. In some cases, it comprises about 220 mg to about 300 mg, suitably about 240 mg to about 280 mg, suitably about 260 mg of a reconstituted tobacco material. In some other cases, it comprises about 320 mg to about 400 mg, suitably about 320 mg to about 370 mg, suitably about 340 mg of a reconstituted tobacco material.

In some cases, the aerosol generating material, which may comprise a tobacco material, suitably the reconstituted tobacco material discussed in the preceding paragraph, may have a nicotine content of between about 5 mg/g and 15 mg/g (dry weight basis), suitably between about 7 mg/g and 12 mg/g. In some cases, the aerosol generating material, which may comprise a tobacco material, may have an aerosol generating agent (suitably glycerol) content of between about 130 mg/g and 170 mg/g, suitably between about 145 mg/g and 155 mg/g (all dry weight basis). In some cases, the aerosol generating material, may have a water content of about 5 to 8 wt % (wet weight basis). In some cases, the aerosol generating material comprises at least about 1.5 mg of nicotine, suitably at least about 1.7 mg, 1.8 mg or 1.9 mg of nicotine. In some cases, the aerosol generating material comprises at least about 25 mg of aerosol generating agent, suitably at least about 30 mg, 32 mg, 34 mg or 36 mg of aerosol generating agent, which may comprise or consist of glycerol in some instances. In some cases, the aerosol generating material comprises aerosol generating agent and nicotine in a weight ratio of at least 10:1, suitably at least 12:1, 14:1 or 16:1.

Suitably, in each aspect and embodiment of the invention discussed herein, the airflow may be at least at least 1.55 L/m or 1.60 L/m. In some cases, the airflow may be less than about 2.00 L/m, 1.90 L/m, 1.80 L/m or 1.70 L/m. In some cases, the airflow may be about 1.65 L/m.

Another aspect of the invention provides an aerosol generating system comprising (i) an aerosol generating article comprising an aerosol generating material, the aerosol generating material comprising nicotine and an aerosol generating agent, and (ii) an aerosol generating device comprising an induction heater, wherein during operation, the article is inserted into the device and an aerosol is generated by using the induction heater to heat the aerosol generating material to at least 150° C., wherein (i) the mean particle or droplet size in the generated aerosol is less than about 1000 nm in an aerosol generated under an airflow of at least 1.50 L/m during a two-second period;

and/or (ii) the aerosol density generated during a two-second period under an airflow of at least 1.50 L/m during the period, is at least 0.1 μg/cc.

In some cases, the aerosol generating material is a solid or a gel material. That is, the system may be a tobacco heating product, also known as a heat-not-burn device. In some cases, the aerosol generating material comprises tobacco. In some cases, the aerosol generating material is solid and comprises tobacco.

In some cases, the article is inserted into the device during operation and an aerosol is generated by using the induction heater to heat the aerosol generating material to at least 150° C., wherein the mean density of the aerosol generated from the aerosol generating material during at least 7 two-second periods under an airflow of at least 1.50 L/m, is at least 0.6 μg/cc, suitably at least 0.8 μg/cc. In other words, the article may generate at least 4.2 μg/cc, suitable at least 5.6 μg/cc of aerosol over the 7 two-second periods.

In some cases, the article is inserted into the device during operation and an aerosol is generated by using the induction heater to heat the aerosol generating material to at least 150° C., wherein the mean density of the aerosol generated from the aerosol generating material during at least 9 two-second periods under an airflow of at least 1.50 L/m, is at least 0.4 μg/cc, suitably at least 0.6 μg/cc. In other words, the article may generate at least 3.6 μg/cc, suitable at least 5.4 μg/cc of aerosol over the 9 two-second periods.

The heater in the device is an induction heater. The susceptor defines a cylindrical chamber into which the article is inserted in use, so that the aerosol generating material is heated by the susceptor. The cylindrical chamber length may be from about 40 mm to 60 mm, about 40 mm to 50 mm or about 40 mm to 45 mm, or about 44.5 mm. The cylindrical chamber diameter may be from about 5.0 mm to 6.5 mm, suitably about 5.35 mm to 6.0 mm, suitably about 5.5 mm to 5.6 mm, suitably about 5.55 mm.

The aerosol generating article may comprise the aerosol generating material and a wrapping material arranged around the aerosol generating material. In some cases, the aerosol generating material comprises tobacco. The tobacco may be any suitable solid tobacco, such as single grades or blends, cut rag or whole leaf, ground tobacco, tobacco fibre, cut tobacco, extruded tobacco, tobacco stem and/or reconstituted tobacco. The tobacco may be of any type including Virginia and/or Burley and/or Oriental tobacco.

The aerosol generating material may be a rod of aerosol generating material. A wrapper may form a tube disposed around the rod of aerosol generating material. As used herein, the term "rod" generally refers to an elongate body which may be any suitable shape for use in an aerosol generating device. In some cases, the rod is substantially cylindrical. The cylindrical body of aerosol generating material may be between about 34 mm and 50 mm in length, suitably between about 38 mm and 46 mm in length, suitably about 42 mm in length. The cylindrical body of aerosol generating material have a diameter of about 5.0 mm to 6.0 mm, suitably about 5.25 mm to 5.45 mm, suitably about 5.35 mm to 5.40 mm, suitably about 5.39 mm. In some cases, the aerosol generating material may fill at least about 85% of the void defined by the susceptor.

The aerosol generating material may comprise one or more of an aerosol generating agent, a binder, a filler and a flavorant.

In some cases, the aerosol generating material may comprise a tobacco composition as described in WO2017/097840, the content of which are incorporated herein by reference.

The aerosol generating article may additional comprise one or more of a filter, a cooling element and a mouthpiece.

In some cases, the aerosol generating article comprises a wrapper, which at least partially surrounds other components of the article, including one or more of a filter, a cooling element, a mouthpiece and the aerosol generating material. In some cases, the wrapper may surround the perimeter of each of these components. The wrapper may have a thickness of between about 10 μm and 50 μm, suitably between about 15 μm and 45 μm or between about 20 μm and 40 μm. In some cases, the wrapper may comprise a paper layer, and in some cases this may have a basis weight of at least about 10 $g \cdot m^{-2}$, 15 $g \cdot m^{-2}$, 20 $g \cdot m^{-2}$ or 25 $g \cdot m^{-2}$ to about 50 $g \cdot m^{-2}$, 45 $g \cdot m^{-2}$, 40 $g \cdot m^{-2}$ or 35 $g \cdot m^{-2}$. In some cases, the wrapper may comprise a non-combustible layer, such as a metallic foil. Suitably, the wrapper may comprise an aluminium foil layer, which may have a thickness between about 3 μm and 15 μm, suitably between about 5 μm and 10 μm, suitably about 6 μm. The wrapper may comprise a laminate structure, and in some cases, the laminate structure may comprise a least one paper layer and at least one non-combustible layer.

In some such cases, ventilation apertures are provided in the wrapper. In some cases, the ventilation ratio provided by the holes (i.e. the amount of inhaled air flowing through the ventilation holes as a percentage of the aerosol volume) may be between about 5% and 85%, suitably at least 20%, 35%, 50% or 60%. The ventilation apertures may be provided in the wrapper in the portion that surrounds one or more of a filter, a cooling element and a mouthpiece.

Referring now to the figures, there is illustrated in FIG. 1 an example of an aerosol generating device 100 for generating aerosol from an aerosol generating medium/material. In broad outline, the device 100 may be used to heat a replaceable article 110 comprising the aerosol generating medium, to generate an aerosol or other inhalable medium which is inhaled by a user of the device 100.

The device 100 comprises a housing 102 (in the form of an outer cover) which surrounds and houses various components of the device 100. The device 100 has an opening 104 in one end, through which the article 110 may be inserted for heating by a heating assembly. In use, the article 110 may be fully or partially inserted into the heating assembly where it may be heated by one or more components of the heater assembly.

The device 100 of this example comprises a first end member 106 which comprises a lid 108 which is moveable relative to the first end member 106 to close the opening 104 when no article 110 is in place. In FIG. 1, the lid 108 is shown in an open configuration, however the cap 108 may move into a closed configuration. For example, a user may cause the lid 108 to slide in the direction of arrow "A".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port. In some examples the socket 114 may be used additionally or alternatively to transfer data between the device 100 and another device, such as a computing device.

Figure 2:
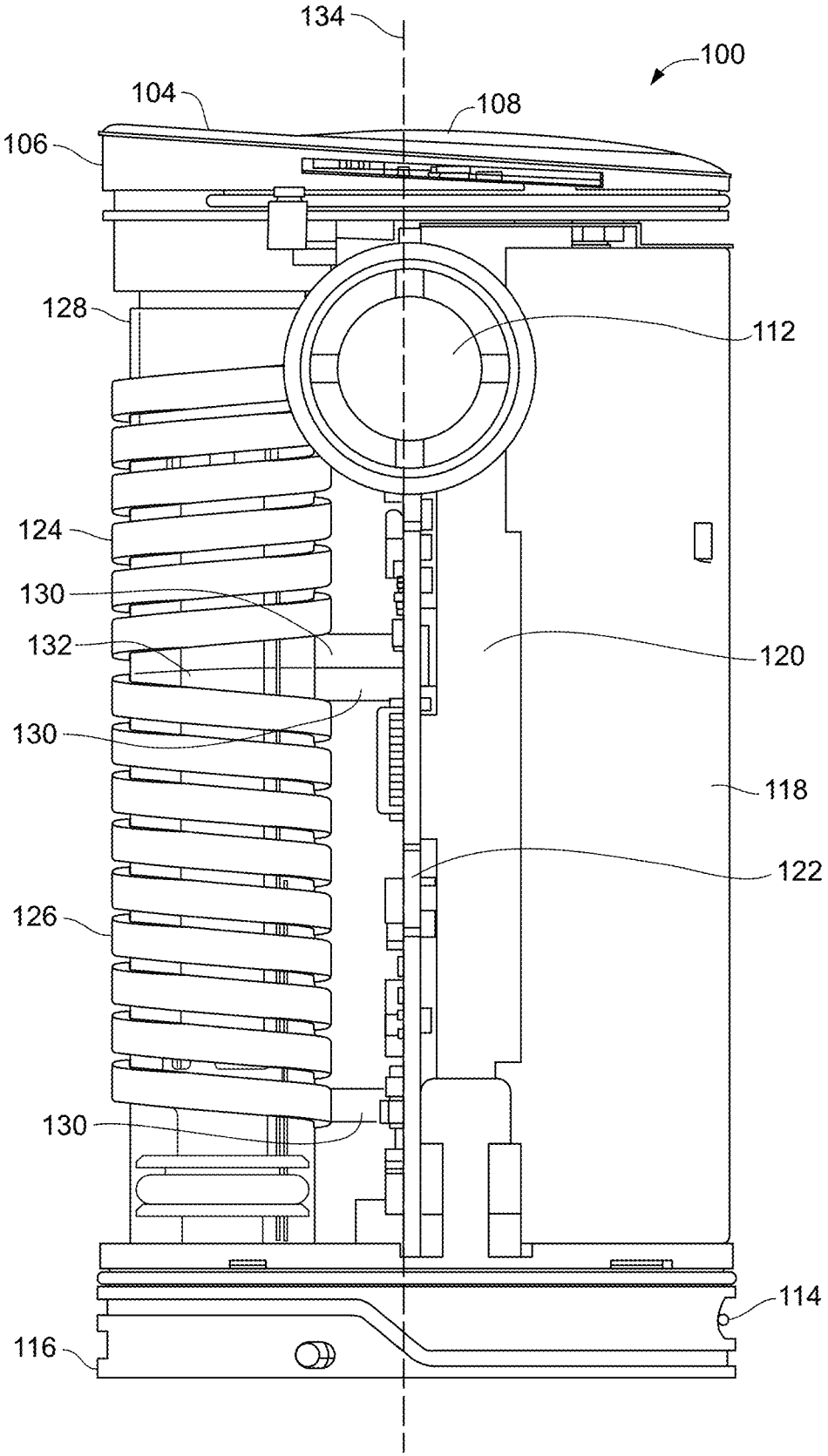
FIG. 2 shows a front view of the aerosol generating device of FIG. 1 with an outer cover removed.

FIG. 2 depicts the device 100 of FIG. 1 with the outer cover 102 removed and without an article 110 present. The device 100 defines a longitudinal axis 134.

As shown in FIG. 2, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. Edges of the outer cover 102 may also define a portion of the end surfaces. In this example, the lid 108 also defines a portion of a top surface of the device 100.

The end of the device closest to the opening 104 may be known as the proximal end (or mouth end) of the device 100 because, in use, it is closest to the mouth of the user. In use, a user inserts an article 110 into the opening 104, operates the user control 112 to begin heating the aerosol generating material and draws on the aerosol generated in the device. This causes the aerosol to flow through the device 100 along a flow path towards the proximal end of the device 100.

The other end of the device furthest away from the opening 104 may be known as the distal end of the device 100 because, in use, it is the end furthest away from the mouth of the user. As a user draws on the aerosol generated in the device, the aerosol flows away from the distal end of the device 100.

The device 100 further comprises a power source 118. The power source 118 may be, for example, a battery, such as a rechargeable battery or a non-rechargeable battery. Examples of suitable batteries include, for example, a lithium battery (such as a lithium-ion battery), a nickel battery (such as a nickel-cadmium battery), and an alkaline battery. The battery is electrically coupled to the heating assembly to supply electrical power when required and under control of a controller (not shown) to heat the aerosol generating material. In this example, the battery is connected to a central support 120 which holds the battery 118 in place.

The device further comprises at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

In the example device 100, the heating assembly is an inductive heating assembly and comprises various components to heat the aerosol generating material of the article 110 via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element, and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, i.e. by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from Litz wire/cable which is wound in a helical fashion to provide helical inductor coils 124, 126. Litz wire comprises a plurality of individual wires which are individually insulated and are twisted together to form a single wire. Litz wires are designed to reduce the skin effect losses in a conductor. In the example device 100, the first and second inductor coils 124, 126 are made from copper Litz wire which has a rectangular cross section. In other examples the Litz wire can have other shape cross sections, such as circular.

The first inductor coil 124 is configured to generate a first varying magnetic field for heating a first section of the susceptor 132 and the second inductor coil 126 is configured to generate a second varying magnetic field for heating a second section of the susceptor 132. In this example, the first inductor coil 124 is adjacent to the second inductor coil 126 in a direction along the longitudinal axis 134 of the device 100 (that is, the first and second inductor coils 124, 126 to not overlap). The susceptor arrangement 132 may comprise a single susceptor, or two or more separate susceptors. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 2, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material to the second inductor coil 126. In some examples, the first and second inductor coils 124, 126 may be substantially identical.

In this example, the first inductor coil 124 and the second inductor coil 126 are wound in opposite directions. This can be useful when the inductor coils are active at different times. For example, initially, the first inductor coil 124 may be operating to heat a first section of the article 110, and at a later time, the second inductor coil 126 may be operating to heat a second section of the article 110. Winding the coils in opposite directions helps reduce the current induced in the inactive coil when used in conjunction with a particular type of control circuit. In FIG. 2, the first inductor coil 124 is a right-hand helix and the second inductor coil 126 is a left-hand helix. However, in another embodiment, the inductor coils 124, 126 may be wound in the same direction, or the first inductor coil 124 may be a left-hand helix and the second inductor coil 126 may be a right-hand helix.

The susceptor 132 of this example is hollow and therefore defines a receptacle within which aerosol generating material is received. For example, the article 110 can be inserted into the susceptor 132. In this example the susceptor 120 is tubular, with a circular cross section.

The device 100 of FIG. 2 further comprises an insulating member 128 which may be generally tubular and at least partially surround the susceptor 132. The insulating member 128 may be constructed from any insulating material, such as plastic for example. In this particular example, the insulating member is constructed from polyether ether ketone (PEEK). The insulating member 128 may help insulate the various components of the device 100 from the heat generated in the susceptor 132.

The insulating member 128 can also fully or partially support the first and second inductor coils 124, 126. For example, as shown in FIG. 2, the first and second inductor coils 124, 126 are positioned around the insulating member 128 and are in contact with a radially outward surface of the insulating member 128. In some examples the insulating member 128 does not abut the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

Figure 3:
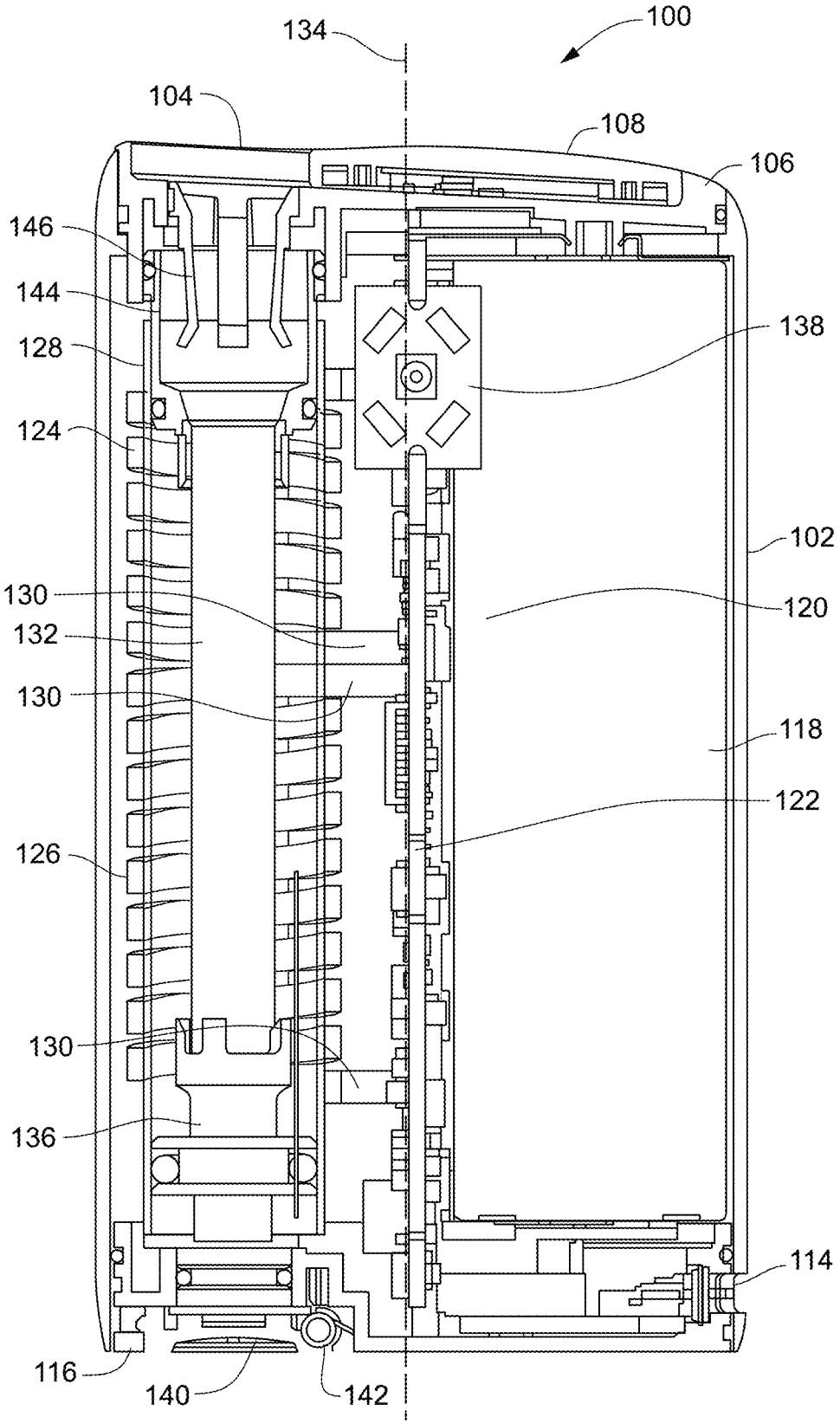
FIG. 3 shows a cross-sectional view of the aerosol generating device of FIG. 1.

FIG. 3 shows a side view of device 100 in partial cross-section. The outer cover 102 is present in this example. The rectangular cross-sectional shape of the first and second inductor coils 124, 126 is more clearly visible.

The device 100 further comprises a support 136 which engages one end of the susceptor 132 to hold the susceptor 132 in place. The support 136 is connected to the second end member 116.

The device may also comprise a second printed circuit board 138 associated within the control element 112.

The device 100 further comprises a second lid/cap 140 and a spring 142, arranged towards the distal end of the device 100. The spring 142 allows the second lid 140 to be opened, to provide access to the susceptor 132. A user may open the second lid 140 to clean the susceptor 132 and/or the support 136.

The device 100 further comprises an expansion chamber 144 which extends away from a proximal end of the susceptor 132 towards the opening 104 of the device. Located at least partially within the expansion chamber 144 is a retention clip 146 to abut and hold the article 110 when received within the device 100. The expansion chamber 144 is connected to the end member 106.

Figure 4:
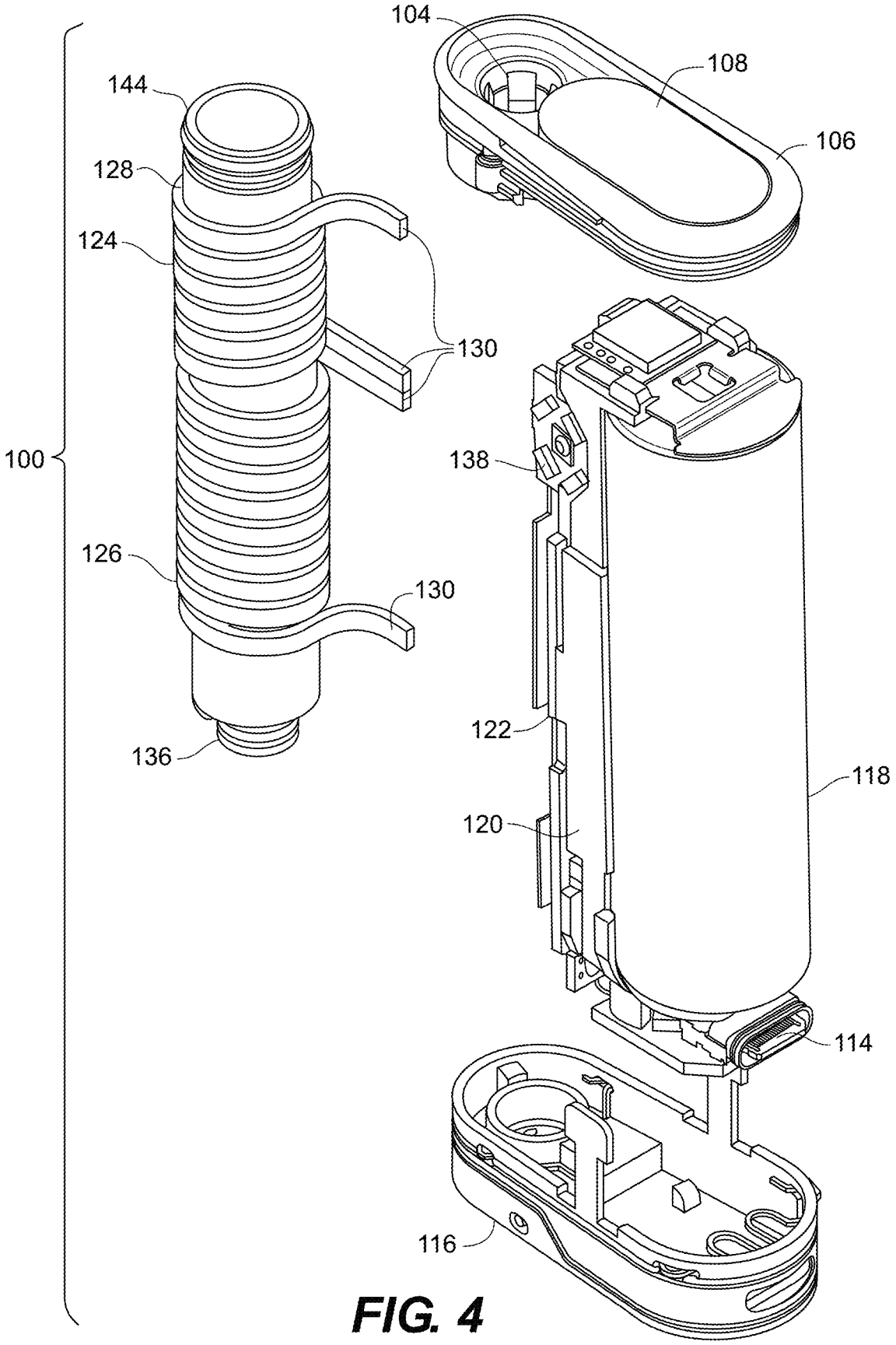
FIG. 4 shows an exploded view of the aerosol generating device of FIG. 2.

FIG. 4 is an exploded view of the device 100 of FIG. 1, with the outer cover 102 omitted.

Figure 5A:
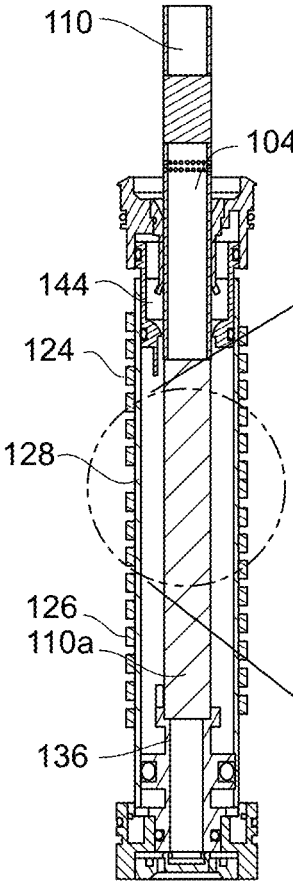
FIG. 5A shows a cross-sectional view of a heating assembly within an aerosol generating device.
Figure 5B:
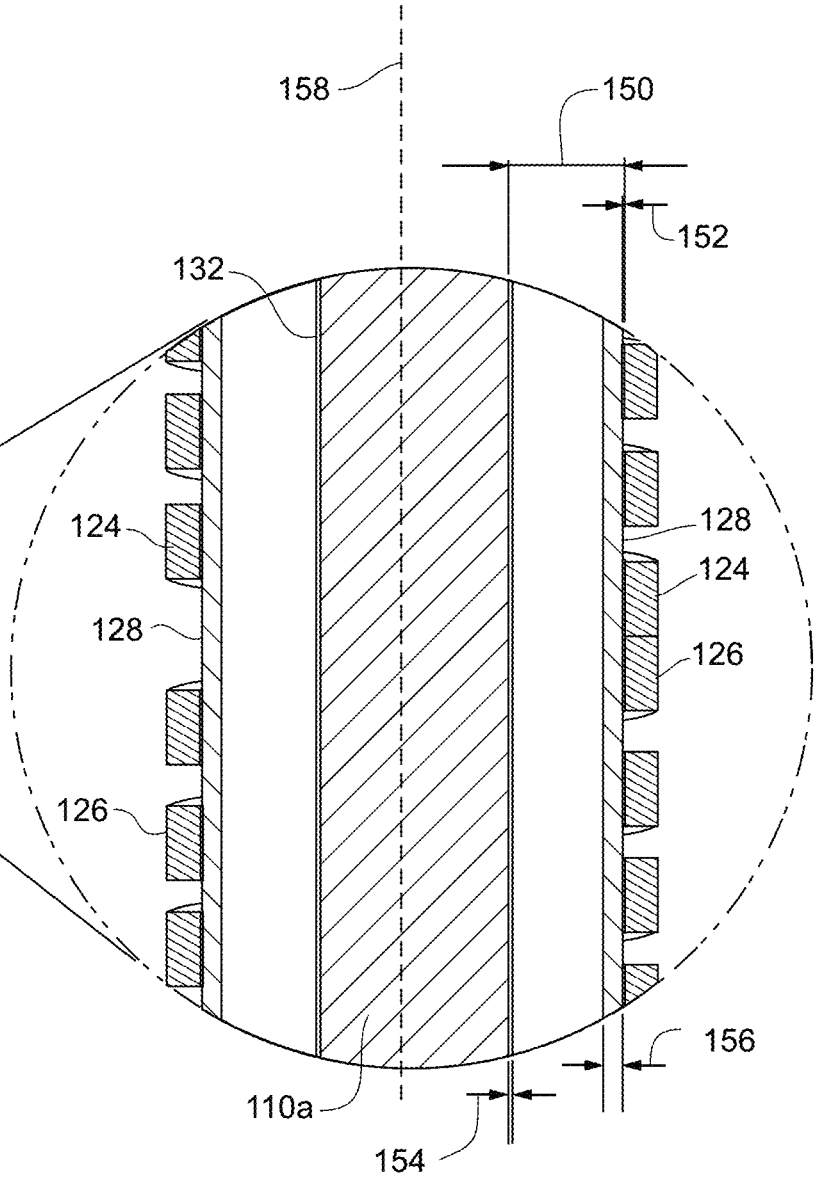
FIG. 5B shows a close-up view of a portion of the heating assembly of FIG. 5A.

FIG. 5A depicts a cross section of a portion of the device 100 of FIG. 1. FIG. 5B depicts a close-up of a region of FIG. 5A. FIGS. 5A and 5B show the article 110 received within the susceptor 132, where the article 110 is dimensioned so that the outer surface of the article 110 abuts the inner surface of the susceptor 132. This ensures that the heating is most efficient. The article 110 of this example comprises aerosol generating material 110*a*. The aerosol generating material 110*a* is positioned within the susceptor 132. The article 110 may also comprise other components such as a filter, wrapping materials and/or a cooling structure.

FIG. 5B shows that the outer surface of the susceptor 132 is spaced apart from the inner surface of the inductor coils 124, 126 by a distance 150, measured in a direction perpendicular to a longitudinal axis 158 of the susceptor 132. In one particular example, the distance 150 is about 3 mm to 4 mm, about 3-3.5 mm, or about 3.25 mm.

FIG. 5B further shows that the outer surface of the insulating member 128 is spaced apart from the inner surface of the inductor coils 124, 126 by a distance 152, measured in a direction perpendicular to a longitudinal axis 158 of the susceptor 132. In one particular example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40-45 mm, or about 44.5 mm.

In one example, the insulating member 128 has a wall thickness 156 of about 0.25 mm to 2 mm, 0.25 to 1 mm, or about 0.5 mm.

The end member 116 may further house one or more electrical components, such as a socket/port 114. The socket 114 in this example is a female USB charging port.

Figure 6A:
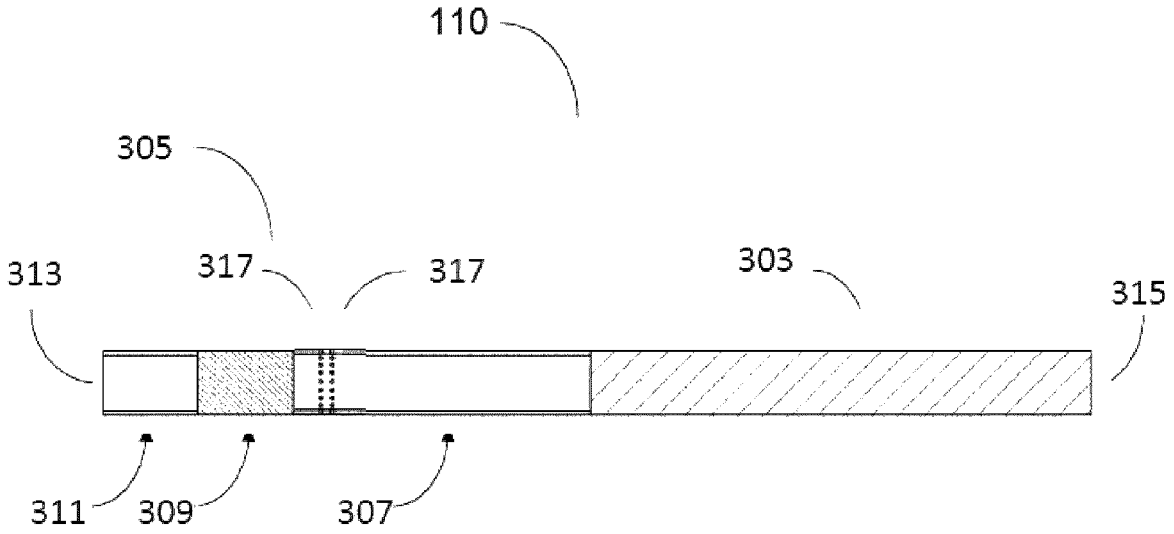
FIG. 6A shows a partially cut-away section view of an example of an aerosol generating article.
Figure 6B:
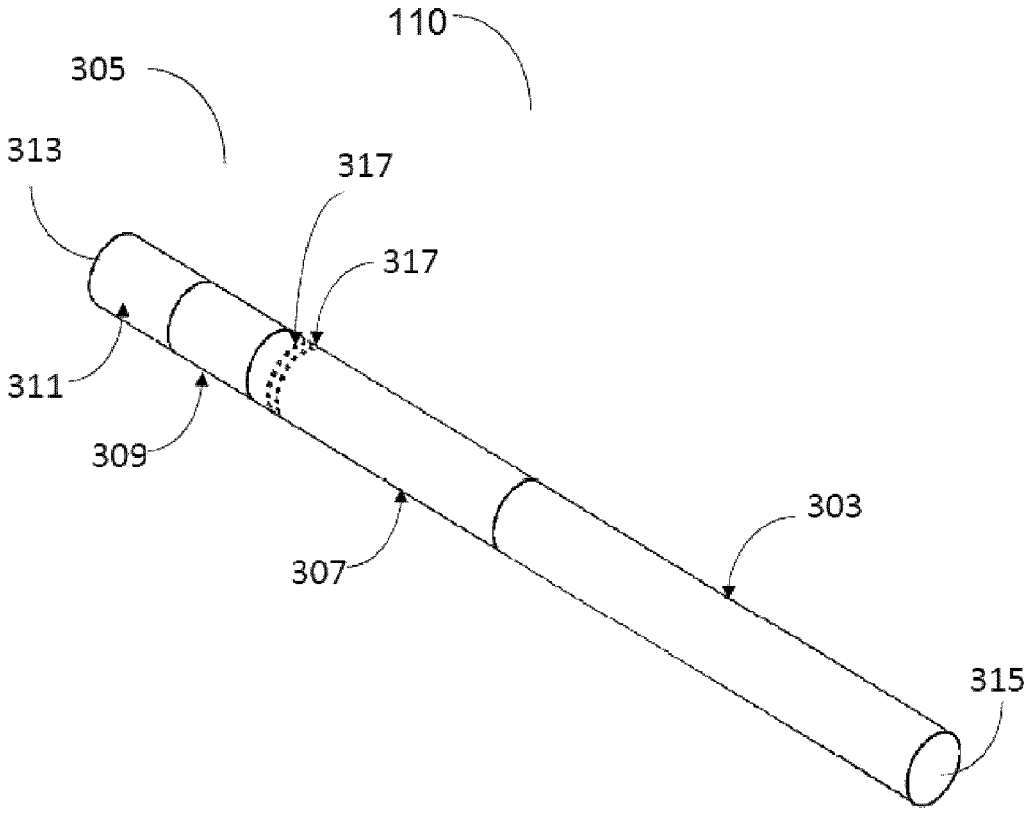
FIG. 6B shows a perspective view of the example aerosol generating article of FIG. 6A.

Referring to FIGS. 6A and 6B, there is shown a partially cut-away section view and a perspective view of an example of an aerosol generating article 110. The article 110. In use, the article 110 is removably inserted into the device 100 shown in FIG. 1 at the opening 104 of the device 100.

The article 110 of one example is in the form of a substantially cylindrical rod that includes a body of aerosol generating material 303 and a filter assembly 305 in the form of a rod. The filter assembly 305 includes three segments, a cooling segment 307, a filter segment 309 and a mouth end segment 311. The article 110 has a first end 313, also known as a mouth end or a proximal end and a second end 315, also known as a distal end. The body of aerosol generating material 303 is located towards the distal end 315 of the article 110. In one example, the cooling segment 307 is located adjacent the body of aerosol generating material 303 between the body of aerosol generating material 303 and the filter segment 309, such that the cooling segment 307 is in an abutting relationship with the aerosol generating material 303 and the filter segment 309. In other examples, there may be a separation between the body of aerosol generating material 303 and the cooling segment 307 and between the body of aerosol generating material 303 and the filter segment 309. The filter segment 309 is located in between the cooling segment 307 and the mouth end segment 311. The mouth end segment 311 is located towards the proximal end 313 of the article 110, adjacent the filter segment 309. In one example, the filter segment 309 is in an abutting relationship with the mouth end segment 311. In one embodiment, the total length of the filter assembly 305 is between 37 mm and 45 mm, more preferably, the total length of the filter assembly 305 is 41 mm.

In one embodiment, the body of aerosol generating material 303 comprises tobacco. However, in other respective embodiments, the body of aerosol generating material 303 may consist of tobacco, may consist substantially entirely of tobacco, may comprise tobacco and aerosol generating material other than tobacco, may comprise aerosol generating material other than tobacco, or may be free of tobacco. The aerosol generating material may include an aerosol generating agent, such as glycerol.

In one example, the body of aerosol generating material 303 is between 34 mm and 50 mm in length, more preferably, the body of aerosol generating material 303 is between 38 mm and 46 mm in length, more preferably still, the body of aerosol generating material 303 is 42 mm in length.

In one example, the total length of the article 110 is between 71 mm and 95 mm, more preferably, total length of the article 110 is between 79 mm and 87 mm, more preferably still, total length of the article 110 is 83 mm.

An axial end of the body of aerosol generating material 303 is visible at the distal end 315 of the article 110. However, in other embodiments, the distal end 315 of the article 110 may comprise an end member (not shown) covering the axial end of the body of aerosol generating material 303.

The body of aerosol generating material 303 is joined to the filter assembly 305 by annular tipping paper (not shown), which is located substantially around the circumference of the filter assembly 305 to surround the filter assembly 305 and extends partially along the length of the body of aerosol generating material 303. In one example, the tipping paper is made of 58 GSM standard tipping base paper. In one example has a length of between 42 mm and 50 mm, and more preferably, the tipping paper has a length of 46 mm.

In one example, the cooling segment 307 is an annular tube and is located around and defines an air gap within the cooling segment. The air gap provides a chamber for heated volatilized components generated from the body of aerosol generating material 303 to flow. The cooling segment 307 is hollow to provide a chamber for aerosol accumulation yet rigid enough to withstand axial compressive forces and bending moments that might arise during manufacture and while the article 110 is in use during insertion into the device 100. In one example, the thickness of the wall of the cooling segment 307 is approximately 0.29 mm.

The cooling segment 307 provides a physical displacement between the aerosol generating material 303 and the filter segment 309. The physical displacement provided by the cooling segment 307 will provide a thermal gradient across the length of the cooling segment 307. In one example the cooling segment 307 is configured to provide a temperature differential of at least 40 degrees Celsius between a heated volatilized component entering a first end of the cooling segment 307 and a heated volatilized component exiting a second end of the cooling segment 307. In one example the cooling segment 307 is configured to provide a temperature differential of at least 60 degrees Celsius between a heated volatilized component entering a first end of the cooling segment 307 and a heated volatilized component exiting a second end of the cooling segment 307. This temperature differential across the length of the cooling element 307 protects the temperature sensitive filter segment 309 from the high temperatures of the aerosol generating material 303 when it is heated by the heating arrangement of the device 100. If the physical displacement was not provided between the filter segment 309 and the body of aerosol generating material 303 and the heating elements of the device 100, then the temperature sensitive filter segment 309 may become damaged in use, so it would not perform its required functions as effectively.

In one example the length of the cooling segment 307 is at least 15 mm. In one example, the length of the cooling segment 307 is between 20 mm and 30 mm, more particularly 23 mm to 27 mm, more particularly 25 mm to 27 mm and more particularly 25 mm.

The cooling segment 307 is made of paper, which means that it is comprised of a material that does not generate compounds of concern, for example, toxic compounds when in use adjacent to the heater arrangement of the device 100. In one example, the cooling segment 307 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 307 is a recess created from stiff plug wrap or tipping paper. The stiff plug wrap or tipping paper is manufactured to have a rigidity that is sufficient to withstand the axial compressive forces and bending moments that might arise during manufacture and while the article 110 is in use during insertion into the device 100.

For each of the examples of the cooling segment 307, the dimensional accuracy of the cooling segment is sufficient to meet the dimensional accuracy requirements of high-speed manufacturing process.

The filter segment 309 may be formed of any filter material sufficient to remove one or more volatilized compounds from heated volatilized components from the aerosol generating material. In one example the filter segment 309 is made of a mono-acetate material, such as cellulose acetate. The filter segment 309 provides cooling and irritation-reduction from the heated volatilized components without depleting the quantity of the heated volatilized components to an unsatisfactory level for a user.

The density of the cellulose acetate tow material of the filter segment 309 controls the pressure drop across the filter segment 309, which in turn controls the draw resistance of the article 110. Therefore the selection of the material of the filter segment 309 is important in controlling the resistance to draw of the article 110. In addition, the filter segment 309 performs a filtration function in the article 110.

In one example, the filter segment 309 is made of a 8Y15 grade of filter tow material, which provides a filtration effect on the heated volatilized material, while also reducing the size of condensed aerosol droplets which result from the heated volatilized material which consequentially reduces the irritation and throat impact of the heated volatilized material to satisfactory levels.

The presence of the filter segment 309 provides an insulating effect by providing further cooling to the heated volatilized components that exit the cooling segment 307. This further cooling effect reduces the contact temperature of the user's lips on the surface of the filter segment 309.

One or more flavors may be added to the filter segment 309 in the form of either direct injection of flavored liquids into the filter segment 309 or by embedding or arranging one or more flavored breakable capsules or other flavor carriers within the cellulose acetate tow of the filter segment 309.

In one example, the filter segment 309 is between 6 mm to 10 mm in length, more preferably 8 mm.

The mouth end segment 311 is an annular tube and is located around and defines an air gap within the mouth end segment 311. The air gap provides a chamber for heated volatilized components that flow from the filter segment 309. The mouth end segment 311 is hollow to provide a chamber for aerosol accumulation yet rigid enough to withstand axial compressive forces and bending moments that might arise during manufacture and while the article is in use during insertion into the device 100. In one example, the thickness of the wall of the mouth end segment 311 is approximately 0.29 mm.

In one example, the length of the mouth end segment 311 is between 6 mm to 10 mm and more preferably 8 mm. In one example, the thickness of the mouth end segment is 0.29 mm.

The mouth end segment 311 may be manufactured from a spirally wound paper tube which provides a hollow internal chamber yet maintains critical mechanical rigidity. Spirally wound paper tubes are able to meet the tight dimensional accuracy requirements of high-speed manufacturing processes with respect to tube length, outer diameter, roundness and straightness.

The mouth end segment 311 provides the function of preventing any liquid condensate that accumulates at the exit of the filter segment 309 from coming into direct contact with a user.

It should be appreciated that, in one example, the mouth end segment 311 and the cooling segment 307 may be formed of a single tube and the filter segment 309 is located within that tube separating the mouth end segment 311 and the cooling segment 307.

A ventilation region 317 is provided in the article 110 to enable air to flow into the interior of the article 110 from the exterior of the article 110. In one example the ventilation region 317 takes the form of one or more ventilation holes 317 formed through the outer layer of the article 110. The ventilation holes may be located in the cooling segment 307 to aid with the cooling of the article 301. In one example, the ventilation region 317 comprises one or more rows of holes, and preferably, each row of holes is arranged circumferentially around the article 110 in a cross-section that is substantially perpendicular to a longitudinal axis of the article 110.

In one example, there are between one to four rows of ventilation holes to provide ventilation for the article 110. Each row of ventilation holes may have between 12 to 36 ventilation holes 317. The ventilation holes 317 may, for example, be between 100 to 500 μm in diameter. In one example, an axial separation between rows of ventilation holes 317 is between 0.25 mm and 0.75 mm, more preferably, an axial separation between rows of ventilation holes 317 is 0.5 mm.

In one example, the ventilation holes 317 are of uniform size. In another example, the ventilation holes 317 vary in size. The ventilation holes can be made using any suitable technique, for example, one or more of the following techniques: laser technology, mechanical perforation of the cooling segment 307 or pre-perforation of the cooling segment 307 before it is formed into the article 110. The ventilation holes 317 are positioned so as to provide effective cooling to the article 110.

In one example, the rows of ventilation holes 317 are located at least 11 mm from the proximal end 313 of the article, more preferably the ventilation holes are located between 17 mm and 20 mm from the proximal end 313 of the article 110. The location of the ventilation holes 317 is positioned such that user does not block the ventilation holes 317 when the article 110 is in use.

Advantageously, providing the rows of ventilation holes between 17 mm and 20 mm from the proximal end 313 of the article 110 enables the ventilation holes 317 to be located outside of the device 100, when the article 110 is fully inserted in the device 100, as can be seen in FIG. 1. By locating the ventilation holes outside of the apparatus, non-heated air is able to enter the article 110 through the ventilation holes from outside the device 100 to aid with the cooling of the article 110.

The length of the cooling segment 307 is such that the cooling segment 307 will be partially inserted into the device 100, when the article 110 is fully inserted into the device 100. The length of the cooling segment 307 provides a first function of providing a physical gap between the heater arrangement of the device 100 and the heat sensitive filter arrangement 309, and a second function of enabling the ventilation holes 317 to be located in the cooling segment, while also being located outside of the device 100, when the article 110 is fully inserted into the device 100. As can be seen from FIG. 1, the majority of the cooling element 307 is located within the device 100. However, there is a portion of the cooling element 307 that extends out of the device 100. It is in this portion of the cooling element 307 that extends out of the device 100 in which the ventilation holes 317 are located.

In the illustrated embodiment, the article has a total length of 83 mm, including a 42 mm long cylindrical tobacco rod (diameter 5.4 mm) containing approximately 260 mg of aerosol generating material. The article has a ventilation ratio of 75%. This is used in a device having a susceptor with a length of 44.5 mm and an internal diameter of 5.55 mm.

In another embodiment (not illustrated), the article has a total length of 75 mm, including a 34 mm long cylindrical tobacco rod (diameter 6.7 mm) containing approximately 340 mg of aerosol generating material. The article may have a ventilation ratio of 60%. This is used in a device having a susceptor with a length of 36 mm and an internal diameter of 7.1 mm.

Examples

The device illustrated in FIGS. 1 to 5B and the article illustrated in FIGS. 6A and 6B, each described above, were employed in these examples.

The susceptor was 44.5 mm in length and had an internal diameter of 5.55 mm.

A number of aerosol generating articles were tested and the data shown below are mean values (unless stated otherwise). The articles had a total length of 83 mm, including a 42 mm long cylindrical tobacco rod (diameter 5.4 mm) containing approximately 260 mg of a reconstituted tobacco material with a nicotine content of 0.8 wt % (±0.1 wt %) and a glycerol content of 15 wt % (±2 wt %) calculated on a dry weight basis. The ventilation ratio was 75%.

Figure 7A:
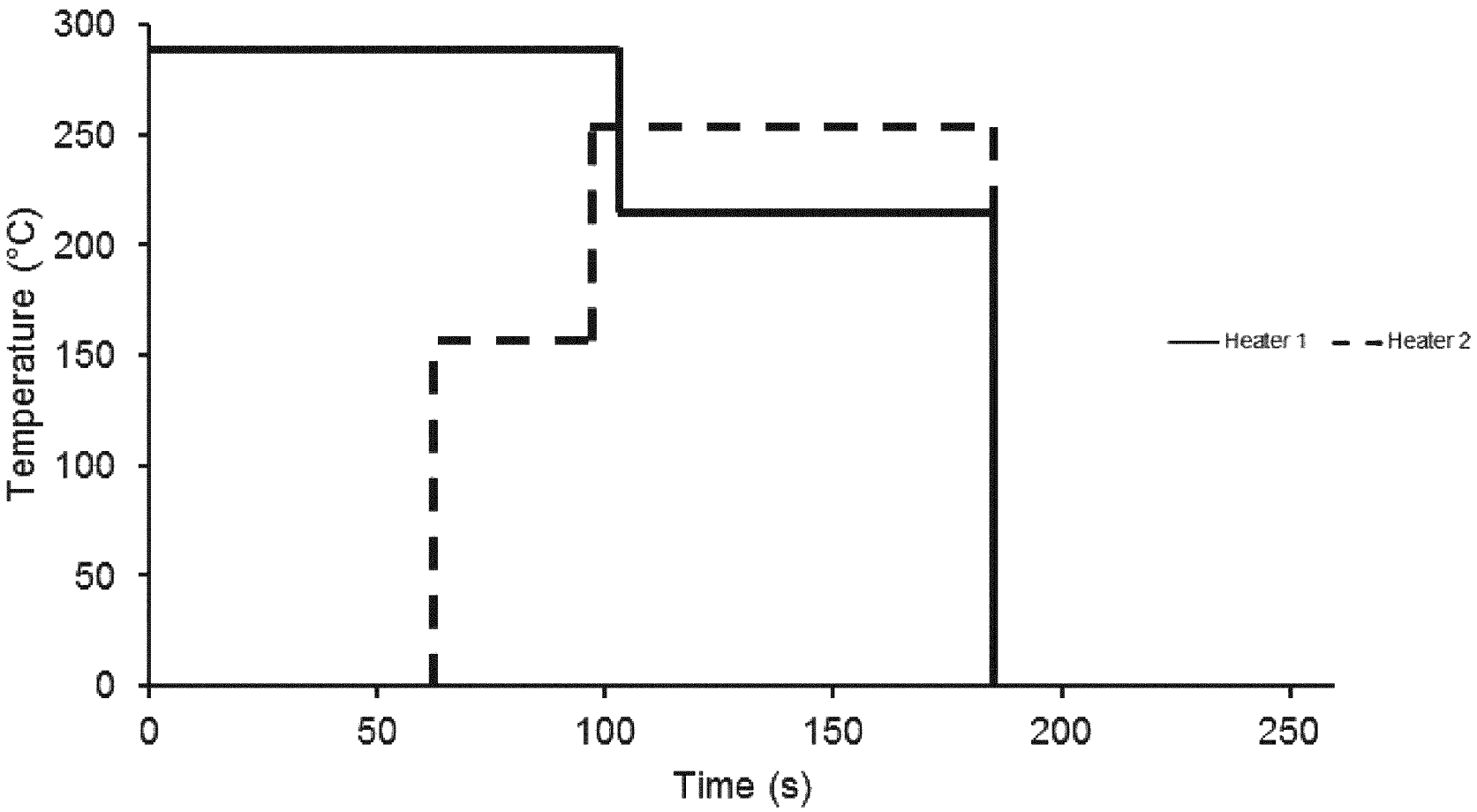
FIGS. 7A and 7B show heat profiles programmed into an example of an aerosol generating device.
Figure 7B:
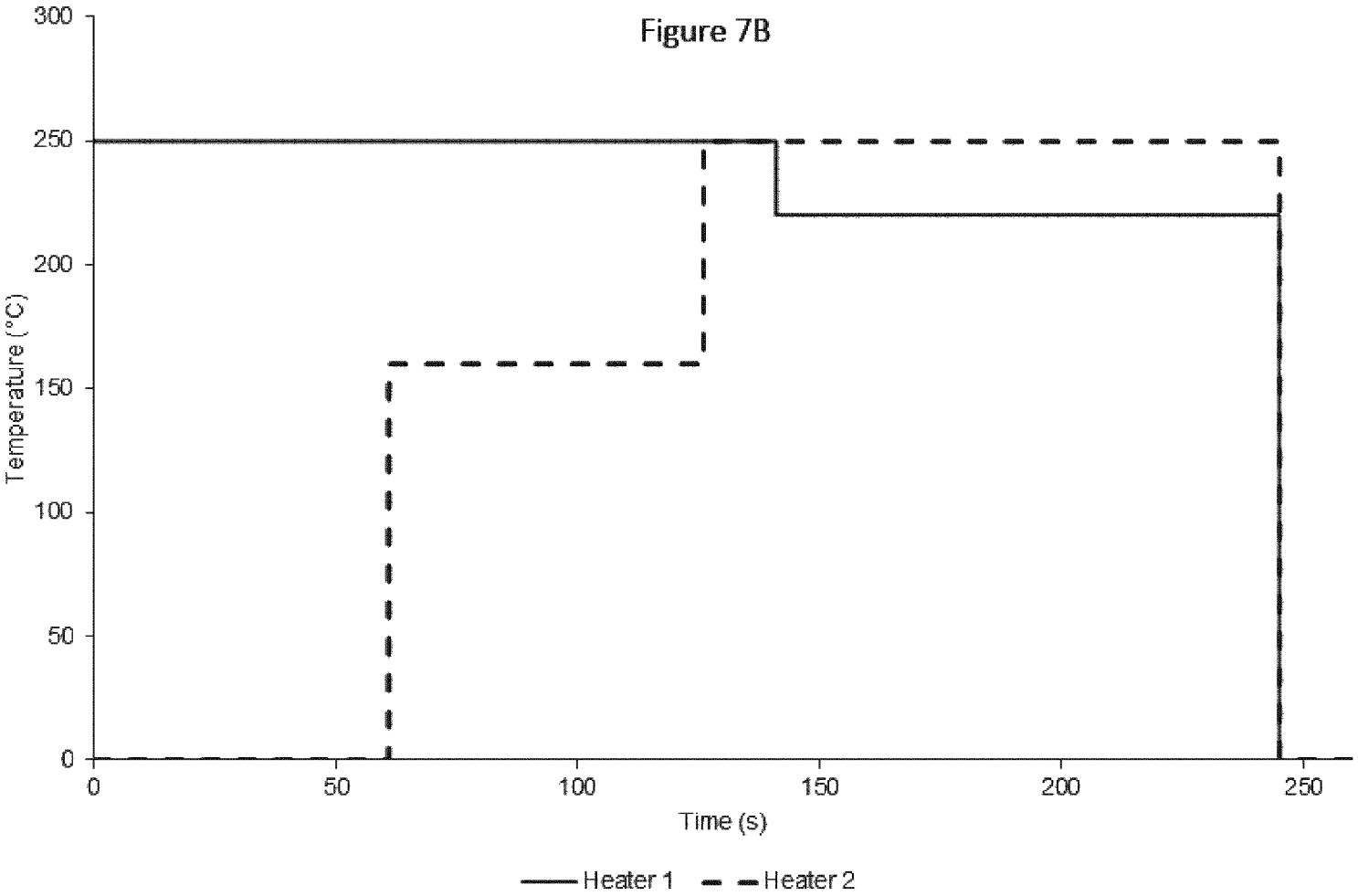
Figure 8A:
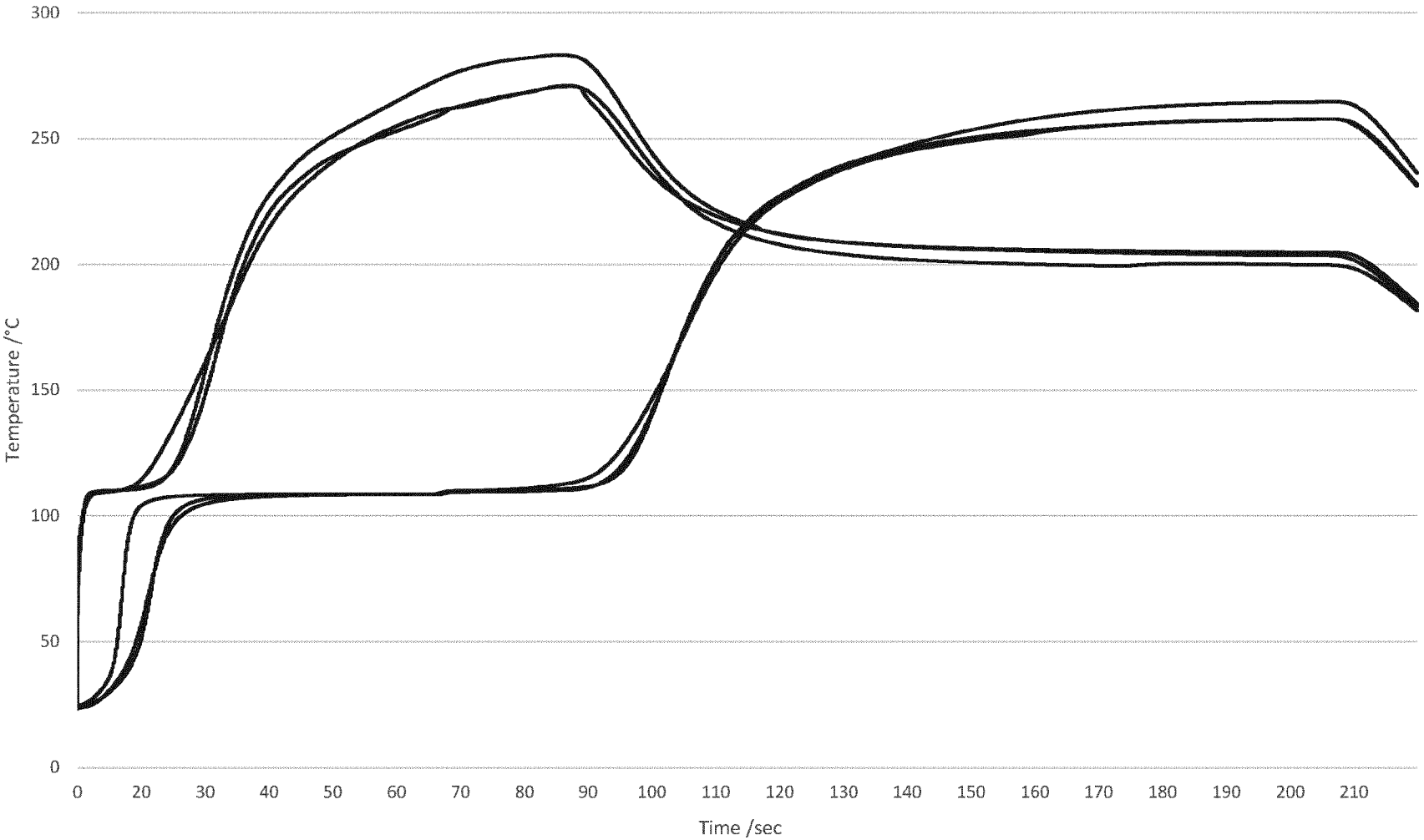
FIGS. 8A and 8B show the tobacco temperature in an aerosol generating article heated by the programmed aerosol generating device of FIGS. 7A and 7B respectively.
Figure 8B:
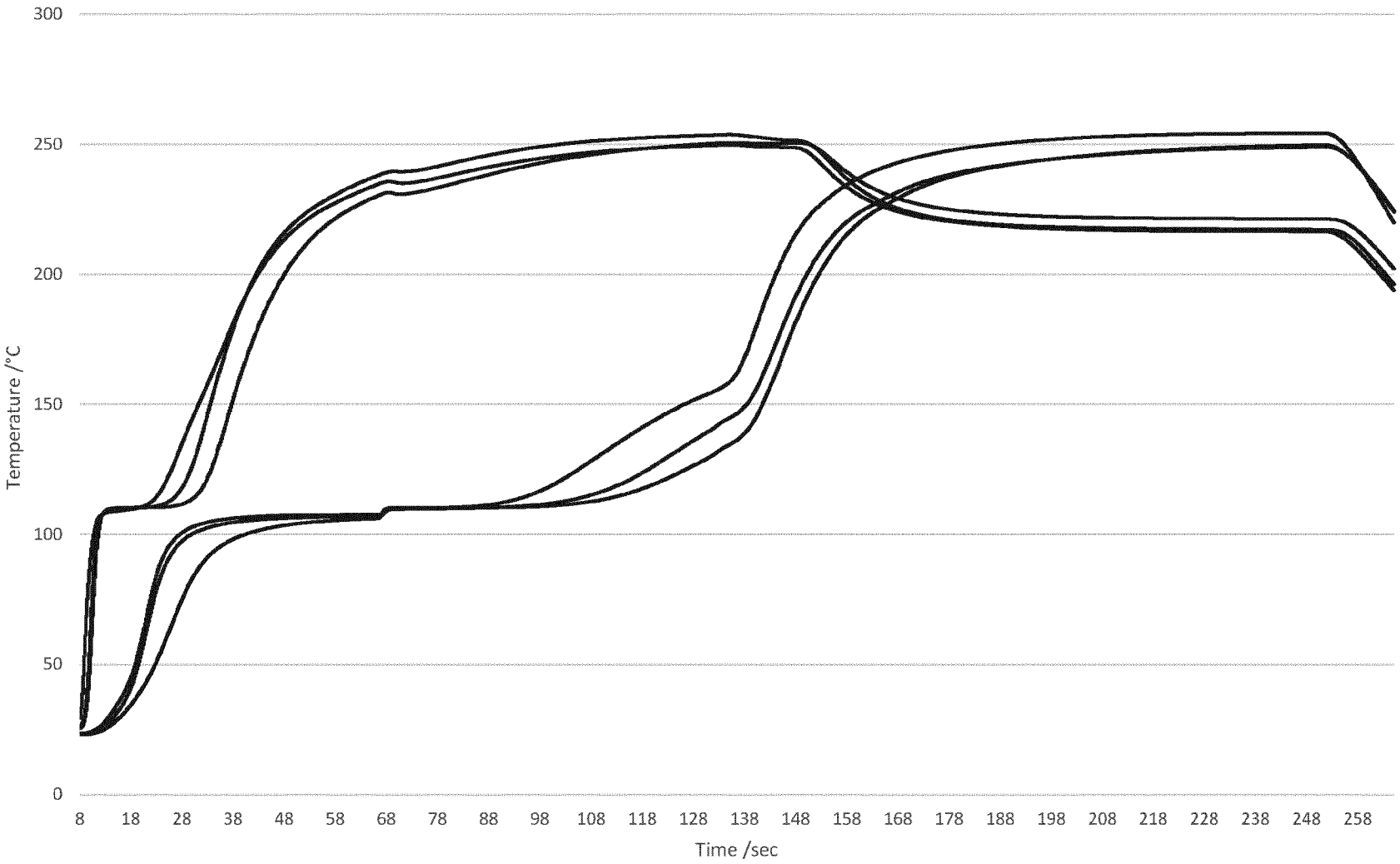

The device had two heating profiles pre-programmed, and these are illustrated in FIGS. 7A and 7B. In each program, the mouth end coil is heated first and the distal coil is heated second. FIGS. 8A and 8B show the tobacco temperature in the respective heating zones for the two pre-programmed heating profiles (for a number of samples, without puffing).

A simulated puff regime was employed in the example. In this regime, the first puff occurs two seconds after the device is turned on (in order to allow time for the heater to warm the tobacco). Thereafter, a 55 mL two-second draw through the device mouthpiece was completed every thirty seconds (i.e. 50 s, 80 s, 110 s, 140 s etc. after the device was turned on) (i.e. the airflow for each puff was 1.65 L/min). The heat profile shown in FIG. 7A is a 3-minute session, allowing for 7 puffs under this regime (where the final puff is taken after the heater has turned off but enough residual heat is present to generate an aerosol). The heat profile shown in FIG. 7B is a 4-minute session, allowing for 9 puffs under this regime (with the final puff again being taken after the heater has turned off). (The FIG. 7B profile uses a lower maximum temperature, resulting is reduced aerosol generation early in the session, and consequently allowing for a longer session.)

Figure 9:
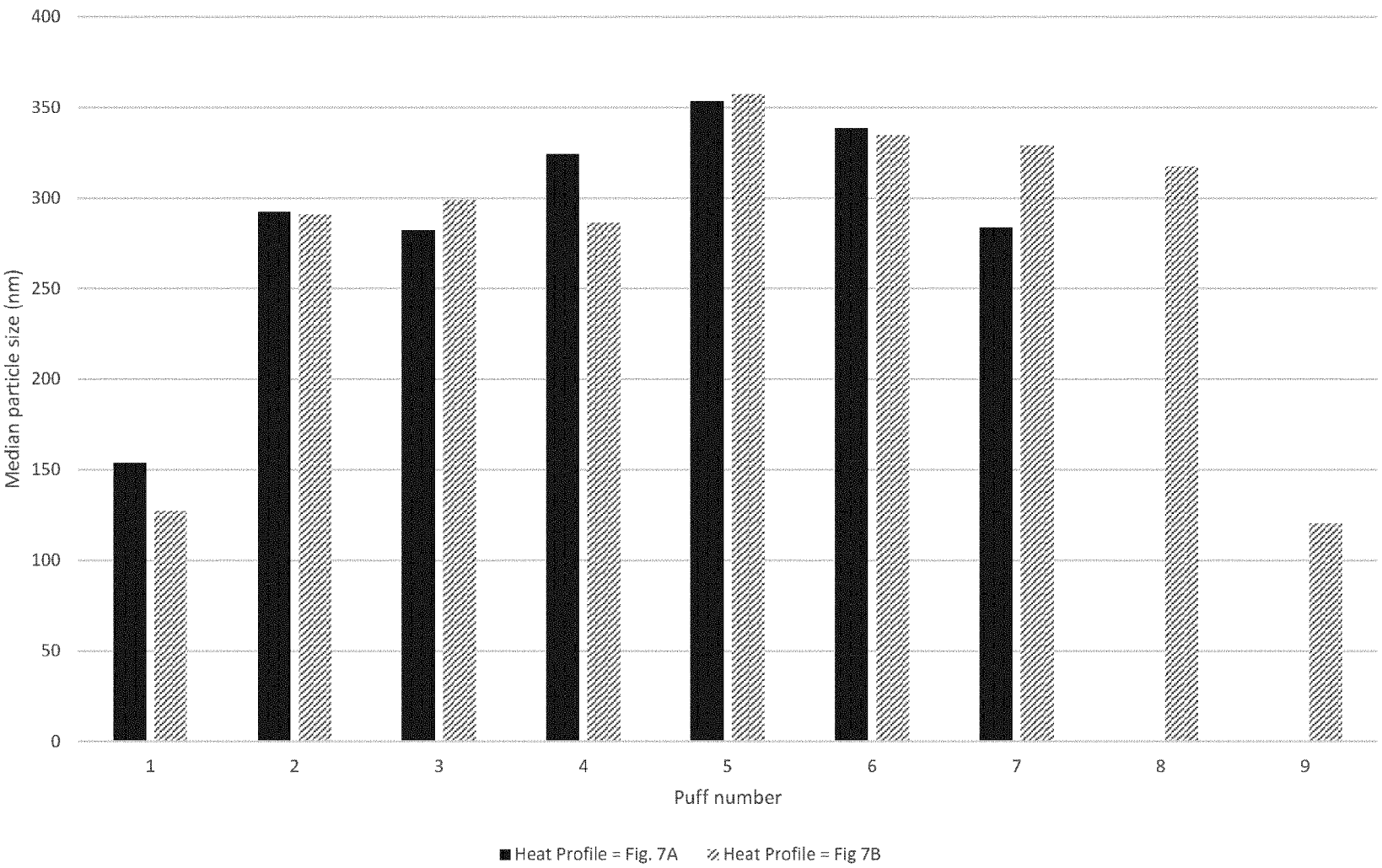
FIG. 9 shows the median particle/droplet diameter in an aerosol generated from an aerosol generating article heated according to an embodiment of the invention.

The median particle size was measured for each puff from 5 aerosol generating articles. The mean values are shown in FIG. 9.

Figure 10:
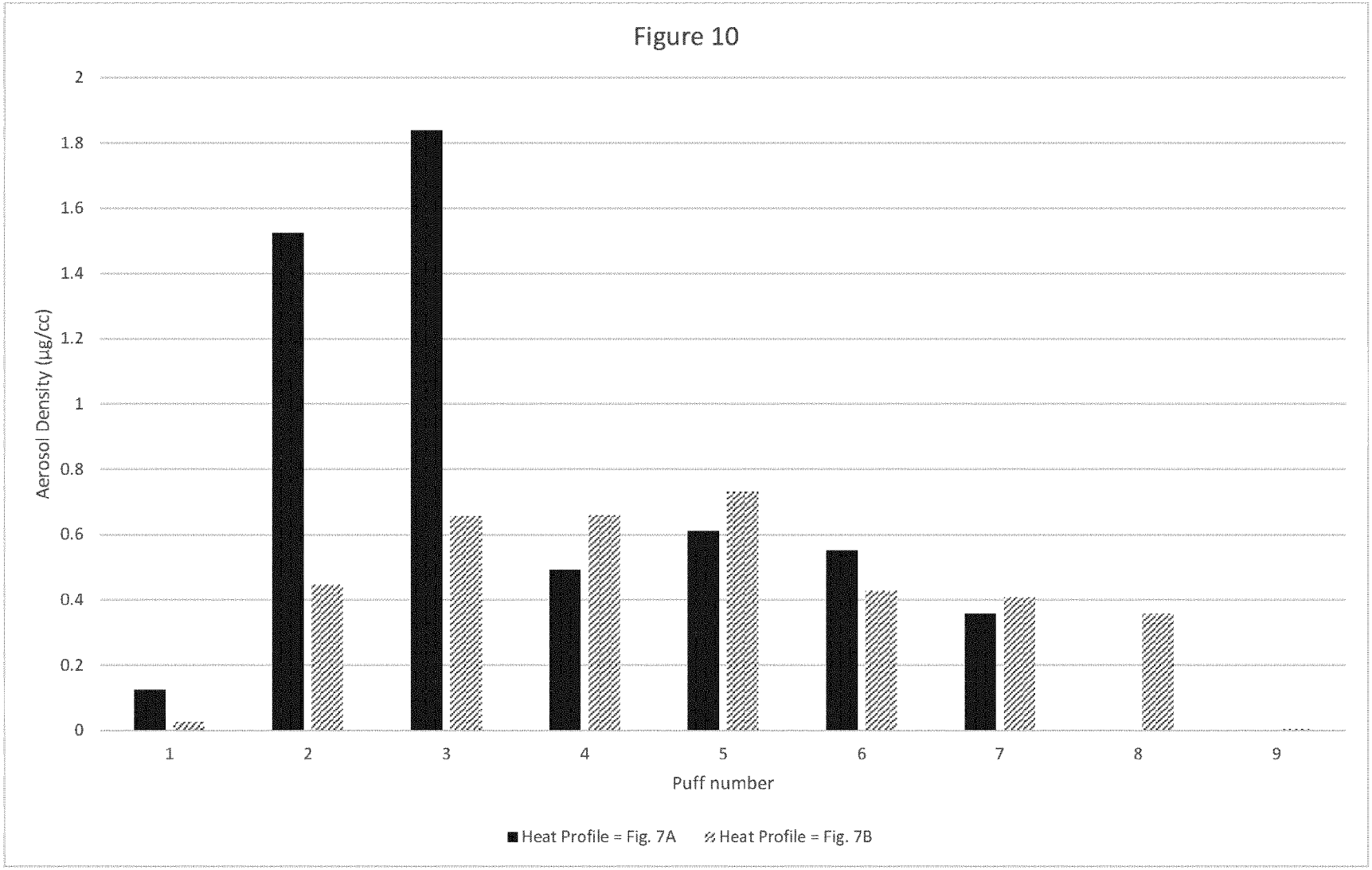
FIG. 10 shows the aerosol density in an aerosol generated from an aerosol generating article heated according to an embodiment of the invention.

The particle density was measured for each puff from 5 aerosol generating articles. The mean values are shown in FIG. 10.

Definitions

As used herein, the term an "aerosol generating agent" is an agent that promotes the generation of an aerosol. An aerosol generating agent may promote the generation of an aerosol by promoting an initial vaporization and/or the condensation of a gas to an inhalable solid and/or liquid aerosol. In some embodiments, an aerosol generating agent may improve the delivery of organoleptic components from the aerosol generating material. Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. Suitably, the aerosol generating agent may comprise, substantially consist of, or consist of glycerol, propylene glycol, triacetin and/or ethyl myristate. In some cases, the aerosol generating agent may comprise, substantially consist of, or consist of glycerol and/or propylene glycol.

As used herein, the terms "flavour" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may comprise natural or nature-identical aroma chemicals. They may be in any suitable form, for example, oil, liquid, powder, or gel.

As used herein, the term "filler" may refer to one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. Alternatively, the term filler may refer to one or more organic filler materials such as wood pulp, cellulose and cellulose derivatives. The filler may comprise organic and inorganic filler materials.

As used herein, the term "binder" may refer to alginates, celluloses or modified celluloses, starches or modified starches, or natural gums. Suitable binders include, but are not limited to: alginate salts comprising any suitable cation; celluloses or modified celluloses, such as hydroxypropyl cellulose and carboxymethylcellulose; starches or modified starches; polysaccharides such as pectin salts comprising any suitable cation, such as sodium, potassium, calcium or magnesium pectate; xanthan gum, guar gum, and any other suitable natural gums; and mixtures thereof. In some embodiments, the binder comprises, substantially consists of or consists of one or more alginate salts selected from sodium alginate, calcium alginate, potassium alginate or ammonium alginate.

As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fibre, cut tobacco, extruded tobacco, tobacco stem, reconstituted tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibres, and may be formed by casting, a Fourdrinier-based paper making-type approach with back addition of tobacco extract, or by extrusion.

All percentages by weight described herein (denoted wt %) are calculated on a dry weight basis, unless explicitly stated otherwise. All weight ratios are also calculated on a dry weight basis. A weight quoted on a dry weight basis refers to the whole of the extract or slurry or material, other than the water, and may include components which by themselves are liquid at room temperature and pressure, such as glycerol. Conversely, a weight percentage quoted on a wet weight basis refers to all components, including water.

For the avoidance of doubt, where in this specification the term "comprises" is used in defining the invention or features of the invention, embodiments are also disclosed in which the invention or feature can be defined using the terms "consists essentially of" or "consists of" in place of "comprises".

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol generating system comprising:

(i) an aerosol generating article comprising an aerosol generating material, the aerosol generating material having a nicotine content of between 5 mg/g and 15 mg/g (dry weight basis) and also comprising an aerosol generating agent, and (ii) an aerosol generating device comprising an induction heater, wherein the article is configured to be inserted into the device to generate an aerosol using the induction heater to heat the aerosol generating material to at least 150° C., such that the mean particle or droplet size in the generated aerosol is less than about 1000 nm under an airflow of at least 1.50 L/m during a two-second period.

2. An aerosol generating system comprising:

(i) an aerosol generating article comprising an aerosol generating material, the aerosol generating material having a nicotine content of between 5 mg/g and 15 mg/g (dry weight basis) and also comprising an aerosol generating agent, and (ii) an aerosol generating device comprising an induction heater, wherein the article is configured to be inserted into the device to generate an aerosol using the induction heater to heat the aerosol generating material to at least 150° C., such that the aerosol density generated during a two-second period under an airflow of at least 1.50 L/m during the period, is at least 0.1 μg/cc.

3. An aerosol generating system according to claim 2, wherein the wherein the mean particle or droplet size in the generated aerosol is less than about 1000 nm.

4. An aerosol generating system according to claim 1, wherein the aerosol generating material is solid and comprises tobacco.

5. An aerosol generating system according to claim 1, wherein the mean particle or droplet size in the generated aerosol is less than about 400 nm.

6. An aerosol generating system according to claim 1, wherein the generated aerosol density is less than about 2.5 μg/cc.

7. An aerosol generating system according to claim 1, wherein the system is configured such that an aerosol is generated by using the induction heater to heat the aerosol generating material to at least 150° C., wherein the mean aerosol density of the aerosol generated during at least 7 two-second periods, under an airflow of at least 1.50 L/m, is at least about 0.6 μg/cc.

8. An aerosol generating system according to claim 1, wherein the system is configured such that, an aerosol is-generated by using the induction heater to heat the aerosol generating material to at least 150° C., wherein the mean aerosol density of the aerosol generated during at least 9 two-second periods, under an airflow of at least 1.50 L/m, is at least about 0.4 μg/cc.

9. A method of generating an aerosol from an aerosol generating material having a nicotine content of between 5 mg/g and 15 mg/g (dry weight basis) and also comprising an aerosol generating agent, the method comprising:

using an induction heater to heat the aerosol generating material to at least 150° C., wherein the mean particle or droplet size in the generated aerosol is less than about 1000 nm in an aerosol generated under an airflow of at least 1.50 L/m during a two-second period.

10. A method according to claim 9, wherein the mean particle or droplet size in the generated aerosol is less than about 400 nm.

11. A method according to claim 9, wherein the aerosol density generated during the two-period is at least about 0.3 μg/cc.

12. A method according to claim 9, wherein the aerosol density generated during the two-second period is less than about 2.5 μg/cc.

13. A method according to claim 9, wherein aerosol generating material is solid and comprises tobacco.

14. A method according to claim 9, wherein the aerosol generated during the two-second period comprises at least 10 μg of aerosol generating agent.

15. A method according to claim 9, wherein the aerosol generated during the two-second period comprises at least 10 μg of nicotine.

16. An aerosol generation system according to claim 1, wherein the aerosol generating material comprises 200 mg to 400 mg reconstituted tobacco.

17. An aerosol generation system according to claim 1, wherein the aerosol generating material has an aerosol generating agent content of between 130 mg/g and 170 mg/g (dry weight basis), and wherein the aerosol generating agent content comprises glycerol.

* * * * *